United States Patent [19]

Dale

[11] Patent Number: 4,493,664

[45] Date of Patent: Jan. 15, 1985

[54] SONOBUOY FLOAT INFLATION AND DEPTH SELECTION INITIATORS

[75] Inventor: John R. Dale, Pennsburg, Pa.

[73] Assignee: The United States of America as represented by the Secretary of the Navy, Washington, D.C.

[21] Appl. No.: 373,943

[22] Filed: May 3, 1982

[51] Int. Cl.[3] ..... B63B 21/00

[52] U.S. Cl. ..... 441/7; 441/26; 441/30; 441/33; 222/5; 367/4

[58] Field of Search ..... 441/1, 2, 6-12, 441/13, 14, 17, 18, 21-34, 41, 92-101; 367/4; 222/5, 54

[56] References Cited

U.S. PATENT DOCUMENTS

| | | | |
|---|---|---|---|
| 1,313,156 | 8/1919 | Armstrong | 441/24 |
| 2,752,615 | 7/1956 | Parker | 441/8 |
| 2,944,268 | 7/1960 | Fruendt | 367/4 |
| 3,093,808 | 6/1963 | Tatnall et al. | 367/4 |
| 3,427,973 | 2/1969 | Beers | 441/19 |
| 3,786,403 | 1/1974 | Will et al. | 367/4 |
| 3,921,120 | 11/1975 | Widenhofer | 367/4 |
| 3,933,206 | 1/1976 | Burke | 222/54 |
| 3,991,475 | 11/1976 | Segrest et al. | 441/24 |
| 4,018,361 | 4/1977 | Fegley | 222/5 |
| 4,024,440 | 5/1977 | Miller | 441/94 |
| 4,096,598 | 6/1978 | Mason | 441/25 |
| 4,143,349 | 3/1979 | Bennett | 367/4 |
| 4,186,370 | 1/1980 | Cupolo et al. | 367/4 |

FOREIGN PATENT DOCUMENTS

| | | | |
|---|---|---|---|
| 8391 | 1/1979 | Japan | 441/98 |
| 1225343 | 3/1971 | United Kingdom | 222/54 |

*Primary Examiner*—Trygve M. Blix
*Assistant Examiner*—Stephen P. Avila
*Attorney, Agent, or Firm*—Robert F. Beers; Henry Hansen

[57] ABSTRACT

A shape-memory alloy initially configured to have engaging potential for a lance, guillotine or pin connected thereto is wrapped in a heating element powered by current from a water activated battery. When the alloy reaches a specific temperature it silently reverts to a predetermined shape. The reversion force is used to displace a lance to pierce a gas cylinder seal to allow inflation of a float and to cut a retaining loop or withdraw a pin to payout a preset length of hydrophone suspension cable.

2 Claims, 3 Drawing Figures

SONOBUOY FLOAT INFLATION AND DEPTH SELECTION INITIATORS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to apparatus for initiating sonobuoy functions and, more particularly, to shape-memory alloy activators, configured and connected to initiate sonobuoy float inflation and hydrophone cable payout and release.

Passive sonobuoys are developed having a hydrophone multiple water depth selection mechanism initiated after deployment in the water. Active sonobuoys are designed for hydrophone depth selection change by radio command when the sonobuoy is in the water. Both sonobuoys respond to depth selection by releasing a preset amount of suspension cable. The mechanical release is typically actuated by an explosive cartridge actuated device (CAD) which while providing the required mechanical force also has the adverse side effect of ensonifying the surrounding water. Additionally, a CAD is used to fire a pointed projectile into the sealed end of a high pressured gas bottle for inflating an expandable flotation device. Here again the CAD device generates a high intensity sound that is directly coupled to the water and can be heard for long distances. Since a requisite feature of today's sonobuoys is covertness, a high intensity sound tends to compromise that feature.

SUMMARY OF THE INVENTION

Accordingly, an object of the present invention is to provide a sonobuoy float inflation initiator which is acoustically quiet. Another object of the invention is to provide a sonobuoy cable cutter depth selector initiator which is acoustically quiet. Yet another object of the invention is to provide a sonobuoy cable release depth change initiator which is acoustically quiet. A further objective of the invention is to provide a shape-memory alloy having a low thermal conductivity material around the entire surface area of the alloy component and preshaped to perform the functions of initiating inflation cable cutting or cable releasing. It is another object of this invention to provide a shape-memory alloy component designed as a free-ended beam center loaded requiring less power to raise the alloy temperature for the austenite state.

According to the present invention, a shape-memory alloy, initially configured to have engaging potential for a lance, guillotine or pin, connected thereto is wrapped in a heating element powered by current from a water activated battery. When the alloy reaches a specific temperature it is caused to revert to a predetermined shape. The reversion force is used to displace a lance to pierce a gas cylinder seal to allow inflation of a flotation collar and to cut a retaining loop or withdraw a pin to payout a preset length of hydrophone suspension cable. The operation of the shape-memory alloy is acoustically quiet, and for heating current utilizes an initial high current drain normally wasted by a water activated battery prior to achieving a stable steady state operating condition. Other objects, advantages, and novel features of the invention will become apparent from the following detailed description when considered in conjunction with the accompanying drawings wherein:

DESCRIPTION OF THE PREFERRED EMBODIMENT

Figure 1:
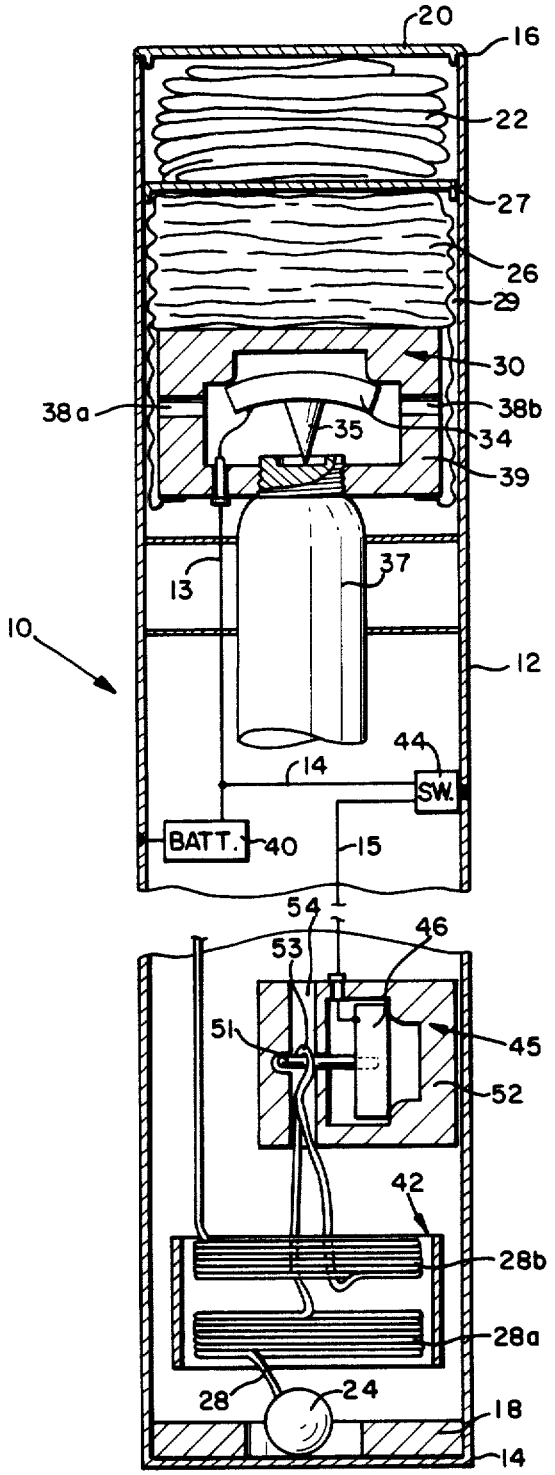
FIG. 1 is a cross-sectional view of parts of a sonobuoy in which is shown a flotation activator and cable release activator according to the invention.
Figure 2:
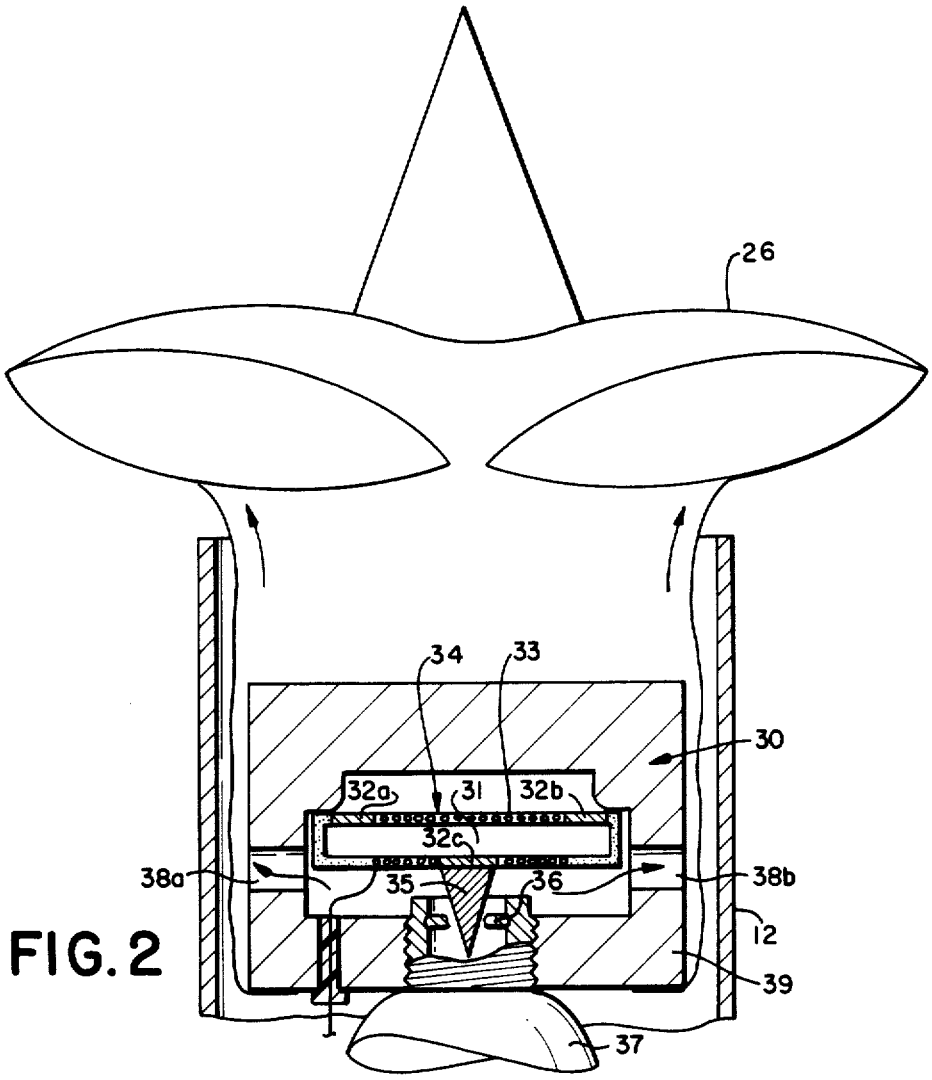
FIG. 2 is an enlarged fragmentary view of the flotation activator after inflation according to the invention of FIG. 1.
Figure 3:
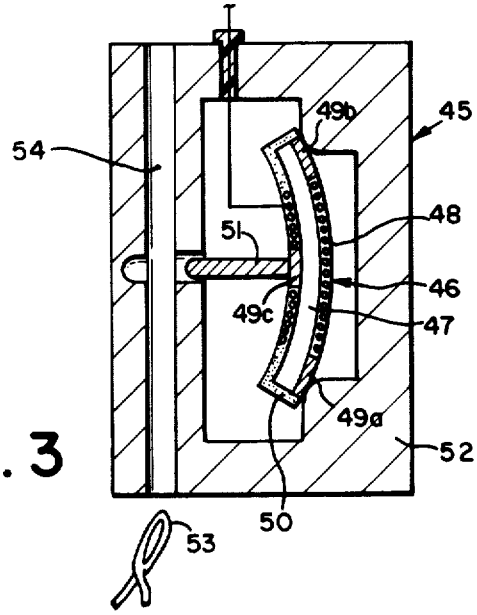
FIG. 3 is an enlarged fragmentary view of the cable release activator after release of a cable according to the invention of FIG. 1.

Referring now to the drawings, wherein like reference characters designate like or corresponding parts throughout the several views, there is shown in FIG. 1 a sonobuoy 10 constructed in accordance with the invention having a casing 12, of a cylindrical construction, a closed lower end 14 and an upper end 16. The lower end is provided with a retaining cap 18 having a weight or ballast and the upper end 16 is initially enclosed by a parachute cover 20.

Casing 12 serves as a container for a plurality of components including a hydrophone 24 for detecting sound, a cable pack 42 for containing a cable 28, a cable release activator 45, a water-activated battery 40, a depth selection switch 44, an instrumentation package, not shown, such as an acoustical detection system for transmitting data in respect to sound as detected by hydrophone 24, a flotation activator 30, an inflatable float 26 and a parachute 22.

Casing 12, adjacent at upper end 16, includes a portion constituting a float chamber 29, a flotation activator 30 having an initiator housing 39, an initiator 34 and a pressurized gas cylinder 37, in communication with inflatable float 26 for inflation thereof when initiated. Inflatable float 26 is retained within chamber 29 by a release plate 27 interposed between float chamber 29 and parachute 22.

A parachute cover 20 is removed as sonobuoy 10 falls from the aircraft. Thereupon parachute 22 is deployed and limits the velocity of sonobuoy 10 through the air to a speed which prevents damage of the sonobuoy upon impact with the water. As parachute 22 is located at the upper end 16 of sonobuoy 10, the lower end 14 thereof will initially engage the water insuring proper distribution of impact forces on sonobuoy 10.

A water-activated battery 40 mounted in the side of sonobuoy 10 immediately detects submerging of casing 12 and supplies current through wire 13 to initiator 34. Initiator 34 is mounted in a cavity of housing 39 adjacent to a gas cylinder seal 36 and is comprised of a shape memory metallic alloy 31 having the anthropomorphic qualities of memory and trainability. Such an alloy is plastically deformed in a martensite crystal structure state at one temperature and will completely recover to an original shape of an austenite crystal structure state on being raised to higher temperature. Metallic alloy 31 has a first and second low thermal conductivity hard plastic strips 32*a* and 32*b* bonded adjacent to the ends thereof for providing bearing surface and a third strip 32*c* bonded on the opposite side and in the center thereof for providing a connection surface, a heating coil 33 such as an insulated electrical conductor wrapped around the alloy interposed between said first and third and said third and second plastic strips, and an insulating blanket 25 such as of Styrofoam TM or Fiberglass TM coating all of initiator 34 except the top surface of the first, second and third plastic strips 32*a, b* and *c* respectively. A cone shaped lance 35 is bonded to plastic strip 32*c* for piercing seal 36 when alloy 31 is heated to the austenite state. Current flow through coil 33 causes the temperature of alloy 31 to increase to a level sufficient to cause a chemical transformation of alloy 31 from the martensite state to the austenite state. The transformation causes alloy 31 to revert back to an original predetermined shape prior to the martensite state and to produce a force sufficient to displace the lance 35 and cause it to puncture the gas retaining seal 36 of cylinder 37. Alloy 31 is selected so that the martensite state remains during the operating temperature range specified for sonobuoy 10. Current for coil 33 is supplied from water-activated battery 40 such as a lithium battery. Lithium battery chemistry requires that a high current be forced to flow immediately after turn on and prior to supplying normal electronic circuit current demands. Typically lithium batteries are momentarily shunted with a dummy load forcing the initial high current flow. In place of using a dummy load coil 33 is connected to utilize the initial current flow and thereby minimize waste of power. When seal 36 is punctured by lance 35 gas flows from cylinder 37 through ports 38*a* and *b* of initiator housing 39 and into inflatable float 26. When float 26 is inflated, a force is exerted on the underside of release plate 27 causing the plate to be released from casing 12 in a conventional manner. A weighted coverplate 18 and the hydrophone 24 each having negative buoyancy are caused to descend from casing 12 held afloat by inflated float 26. Cable 28 is paid out from cable pack 42 as hydrophone 24 descends and transfers signals from hydrophone 24 to the instrumentation package not shown. Cable 28 is wound into two spools, a first spool contains cable section 28*a* and a second spool contains cable section 28*b*. The depth to which hydrophone 24 descends depends upon the number of spools releasable as determined by selection made by the setting of depth selection switch 44 prior to deployment of sonobuoy 10. The selection can also be made remotely by radio control of an electronic switch. Immediately upon the submerging of casing 12 current from battery 40 is fed through wire 14 through switch 44 through wire 15 to a cable release initiator 46. In a first selection position switch 44 is normally open preventing current flow to initiator 46 and allowing only cable section 28*a* to payout from pack 42. In a second position of selector switch 44 current flow is provided through switch 44 to initiator 46. Initiator 46 is mounted within a housing 52 adjacent to a slot 54 and is comprised of a metallic alloy 47 having the same qualities of memory and trainability as metallic alloy 31. Metallic alloy 47 has first and second low thermal conductivity hard plastic strips 49*a* and *b* bonded adjacent to the ends thereof for providing a bearing surface and a third strip 49*c* bonded on the opposite side and in the center thereof for providing a connection surface, a heating coil 48 such as an insulated electrical conductor wrapped around alloy 47 interposed between said first and third and said third and second plastic strips, and an insulating blanket 50 such as of Styrofoam TM or Fiberglass TM coating all of initiator 46 except the top surface of the first, second and third plastic strips 49*a, b* and *c*, respectively. A pin 51 is bonded to plastic strip 49*c* to provide a cable length dispenser stop. A cable loop 53 interposed between cable sections 28*a* and 28*b* provides an attachment point for dividing the sections and through which pin 51 is inserted to prevent release of cable section 28*b*. A slot 54 adjacent to said housing 52 cavity provides a guide to position loop 53. Current flow through coil 48 causes the temperature of alloy 47 to increase to a level sufficient to cause a chemical transformation of alloy 47 from the martensite state to the austenite state. The transformation causes alloy 47 to revert back to an original predetermined shape prior to the martensite state and to produce a force sufficient to withdraw pin 51 and thereby causing loop 53 of cable 28 to be released allowing the second spool containing cable section 28*b* to be released. In another embodiment switch 44 when selected for maximum depth allows current to pass to a shape-memory alloy which when heated to the proper temperature applies a force activating a guillotine cutter for cutting through a retainer cable. The cut retainer cable releases cable section 28*b* for payout from reel 42.

In summary, a water activated battery 40 upon submergence into the water provides a current through coil 33 of inflation initiator 34 heating it to the austenite state thereby creating a force sufficient to displace an attached lance 35 to penetrate seal 36 of cylinder 37. As a result the released gas is communicated into inflatable float 26 causing inflation thereof and rapid release from casing 12. Float 26 provides sufficient buoyancy to keep sonobuoy 10 floating on the surface of the water. Current from battery 40 is simultaneously fed to a depth selection switch 44. When switch 44 is selected to a first position cable section 28*a* of pack 42 is released allowing hydrophone 24 to descend to a first depth. When switch 44 is selected to a second position current is supplied through coil 48 heating alloy 47 to a temperature sufficient to withdraw a pin 50 from within a retaining cable loop 53 interposed between cable sections 28*a* and 28*b* thereby allowing section 28*b* to payout from reel 42 and allowing hydrophone 24 to deploy to a second depth.

It should be apparent that the invention as described hereinabove provides a sonobuoy flat inflation initiator which applies force to a lance for penetrating a gas cylinder seal in an acoustically quiet manner. Additionally the invention provides a cable release initiator for selecting a plurality of hydrophone depths in an acoustically quiet manner. The invention further provides purposeful utilizing of the initial high current drain requirements of a lithium battery sonobuoy power supply. The invention also provides shape memory alloy structural components designed as a free end beam with center loading. The invention provides structural components of shape memory alloy which are smaller for the same center force and deflection as in a constrained beam and requires less power to raise the alloy temperature to the austenite state.

While the foregoing description and drawing represent the preferred embodiment of the present invention, it would be obvious to those skilled in the art that various changes and modifications may be made therein without departing from the true spirit and scope of the present invention.

What is claimed is:

1. A buoy comprising in combination:

a casing;

deployable means releasably stored within said casing, said deployable means comprises an inflatable float;

shape-memory means, transformable to a predetermined shape by heating, mounted within said casing and operatively connected to release said deployable means adjacent thereto for deployment thereof when transformed, said shape-memory means comprises actuator means mounted within said casing, connected to the float, and having a cavity, an input port leading into the cavity, and two output ports communicating between the cavity and the float, pressurized gas means connected to the input port and having a rupturable seal for retaining the gas, and shape-memory lance means disposed within the cavity for penetrating the seal when heated, said shape-memory lance means comprises a shape-memory alloy, a coil wrapped around the alloy, and a lance secured to the alloy, said alloy having a first shape positioning the lance to penetrate the seal and a second shape when heated such that the lance penetrates the seal; and condition responsive means within said casing for heating and transforming said shape-memory means, said condition responsive means comprises energizing means electrically connected to the shape-memory lance means for heating the shape-memory alloy.

2. A deployable buoy, comprising, in combination:

a casing;

an inflatable float stored within said casing at one end;

first actuator means mounted within said casing and connected to said float, said first actuator means having a cavity, an input port leading into said cavity, an output port communicating between said cavity and said float, pressurized gas means connected to said input port having a rupturable seal, and shape-memory lance means, transformable to a predetermined shape, within said cavity adjacent to said seal for penetration thereof when heated, said shape-memory lance means comprising a shape-memory alloy, a coil wrapped around the alloy, and a lance secured thereto, the alloy having a first shape positioning the lance to penetrate the seal and a predetermined second shape when heated such that the lance penetrates the seal;

a cable pack mounted within said casing at the other end having a cable wound onto at least two spools, and a loop interposed between the spools for providing a predetermined payout length;

second actuator means mounted within said casing having a cavity, a slot adjacent to said cavity for positioning said loop, and shape-memory pin means, transformable to a predetermined shape, within said cavity extending into said loop for release thereof when heated, said shape-memory pin means comprising a shape-memory alloy, a coil wrapped around the alloy, and a pin secured to the alloy, the alloy having a first shape positioning the pin within the cable loop and a predetermined second shape when heated such that the pin is withdrawn from the loop; and energizing means electrically connected to said first and second actuator means for heating said shape-memory lance means and said shape-memory pin means.

* * * * *